US009266354B2

(12) United States Patent
Moehringer et al.

(10) Patent No.: US 9,266,354 B2
(45) Date of Patent: Feb. 23, 2016

(54) APPARATUS FOR PRINTING A CURVED SURFACE OF AN OBJECT

(71) Applicant: HEIDELBERGER DRUCKMASCHINEN AG, Heidelberg (DE)

(72) Inventors: Markus Moehringer, Weinheim (DE); Alexander Matern, Oftersheim (DE); Alexander Weber, Weinheim (DE); Stefan Maier, Dielheim (DE); Helge Grandt, Reilingen (DE); Matthias Noell, Weiterstadt (DE); Tobias Mueller, Hirschberg (DE); Bernhard Mechler, Heidelberg (DE); Martin Schnaiter, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/670,698

(22) Filed: Mar. 27, 2015

(65) Prior Publication Data

US 2015/0273864 A1 Oct. 1, 2015

(30) Foreign Application Priority Data

Mar. 27, 2014 (DE) ..... 10 2014 004 507

(51) Int. Cl.
*B41J 3/00* (2006.01)
*B41J 3/407* (2006.01)
*B41J 11/00* (2006.01)

(52) U.S. Cl.
CPC ..... *B41J 3/4073* (2013.01); *B41J 11/002* (2013.01)

(58) Field of Classification Search
USPC ..... 347/2–5, 102
See application file for complete search history.

(56) References Cited

U.S. PATENT DOCUMENTS

| | | | | |
|---|---|---|---|---|
| 8,079,697 | B2 * | 12/2011 | Niekawa | 347/102 |
| 2002/0097280 | A1 * | 7/2002 | Loper et al. | 347/2 |
| 2013/0019566 | A1 | 1/2013 | Schach | |

FOREIGN PATENT DOCUMENTS

| | | | |
|---|---|---|---|
| DE | 3526769 | A1 | 1/1987 |
| DE | 102007036752 | A1 | 2/2009 |
| DE | 102009058212 | A1 | 6/2011 |
| DE | 102011009391 | A1 | 7/2012 |
| DE | 102011009393 | A1 | 7/2012 |
| DE | 102012010617 | A1 | 12/2013 |
| DE | 102012209085 | A1 | 12/2013 |
| JP | 11320863 | A | 11/1999 |
| WO | 2011154628 | A1 | 12/2011 |
| WO | 2012022746 | A1 | 2/2012 |

* cited by examiner

*Primary Examiner* — Lam Nguyen
(74) *Attorney, Agent, or Firm* — Laurence A. Greenberg; Werner H. Stemer; Ralph E. Locher

(57) ABSTRACT

An apparatus for printing a curved surface of an object, for example a ball includes a stationary printing unit for printing the object, the printing unit including an inkjet print head producing a print on the object surface in an active region of the print head, a curing unit for curing the print, the curing unit including a radiant heater curing the print in an active region of the radiant heater, a movable holding unit for receiving the object in a receiving region, moving the object from the receiving region into the active region of the print head, moving the object in the active region of the print head during production of the print and moving the object into the active region of the curing unit, and a control unit for controlling the movements of the holding unit, the production of the print and the curing of the print.

14 Claims, 3 Drawing Sheets

APPARATUS FOR PRINTING A CURVED SURFACE OF AN OBJECT

CROSS-REFERENCE TO RELATED APPLICATION

This application claims the priority, under 35 U.S.C. §119, of German Patent Application DE 10 2014 004 507.2, filed Mar. 27, 2014; the prior application is herewith incorporated by reference in its entirety.

BACKGROUND OF THE INVENTION

Field of the Invention

The present invention relates to an apparatus for printing on a curved surface of an object.

The invention lies in the technical field of inkjet printing of spatially extended, three-dimensional objects or bodies or their surfaces.

It is already known to print on such objects in special apparatuses. For example, golf balls can be printed individually by inkjet in specially configured printing apparatuses. An apparatus of that type is disclosed in Japanese Patent Application JP 11320863 A. Golf balls are very small objects and their handling is therefore not very problematic. In the case of larger objects, for example soccer balls, the handling becomes more difficult. The width of a print head is then no longer sufficient, for example, to print one half of the ball in one pass. In addition, due to the size and curvature of the ball, edge nozzles of the print head are at too great a spacing from the surface of the ball and therefore print imprecisely. The ball therefore has to be moved under the print head, in particular has to be rotated and the print head has to be controlled correspondingly. A holding apparatus is required for the movement of the ball. Similar problems occur in differently shaped, large objects, for example bags, vehicle trimmed parts or the like. Collisions can also occur and are to be avoided. German Patent Application DE 10 2009 058 212 A1 has also already disclosed using a robot to move the object.

SUMMARY OF THE INVENTION

It is accordingly an object of the invention to provide an improved apparatus for printing a curved surface of an object, which overcomes the hereinafore-mentioned disadvantages of the heretofore-known apparatuses of this general type and which makes it possible to provide 3D objects with an imprint on their surface.

With the foregoing and other objects in view there is provided, in accordance with the invention, an apparatus for printing a curved surface of an object, comprising a stationary printing unit for printing the object, the printing unit including an inkjet print head, and the print head producing a print on the surface of the object in an active region of the print head, a curing unit for curing the print, the curing unit including a radiant heater, and the radiant heater curing the print in an active region of the radiant heater, a movable holding unit for receiving the object in a receiving region, for moving the object from the receiving region into the active region of the print head, for moving the object in the active region of the print head during the production of the print and for moving the object into the active region of the curing unit, and at least one control unit for controlling the movements of the holding unit, the production of the print and the curing of the print.

One preferred development of the apparatus according to the invention can be distinguished by the fact that the holding unit includes a plurality of movement units, each movement unit generating a linear or rotational movement, and only one movement unit being active for the linear or rotational movement of the object from the receiving region into the active region of the print head and from there into the active region of a further print head or into the active region of the radiant heater.

Another preferred development of the apparatus according to the invention can be distinguished by the fact that the printing unit includes a plurality of print heads, the print heads being disposed substantially on a horizontally oriented circle and spaced apart from one another in such a way that nozzle rows of the print heads are oriented substantially radially with respect to the circle.

A further preferred development of the apparatus according to the invention can be distinguished by the fact that the curing unit is disposed substantially on the horizontally oriented circle and spaced apart from the print heads.

An added preferred development of the apparatus according to the invention can be distinguished by the fact that the printing unit includes a plurality of print heads, the print heads being disposed substantially on a horizontally oriented straight line and spaced apart from one another in such a way that nozzle rows of the print heads are oriented substantially perpendicularly with respect to the straight line.

An additional preferred development of the apparatus according to the invention can be distinguished by the fact that the curing unit is disposed substantially on the horizontally oriented straight line and spaced apart from the print heads.

Yet another preferred development of the apparatus according to the invention can be distinguished by the fact that the holding unit includes a plurality of movement units, a first movement unit being disposed substantially on a vertical axis and substantially perpendicularly below the center point of the circle and making a linear movement of the object vertically possible.

Yet a further preferred development of the apparatus according to the invention can be distinguished by the fact that a second movement unit is disposed on the first movement unit and is disposed substantially on the vertical axis and makes a rotational movement of the object about the vertical axis possible.

Yet an added preferred development of the apparatus according to the invention can be distinguished by the fact that a third movement unit is disposed on the second movement unit and makes a rotational movement of the object about a radial axis possible.

Yet an additional preferred development of the apparatus according to the invention can be distinguished by the fact that a fourth movement unit is disposed on the second movement unit and makes a linear movement of the object in the radial direction possible, and that a third movement unit is disposed on the fourth movement unit and makes a rotational movement of the object about a radial axis possible.

Again another preferred development of the apparatus according to the invention can be distinguished by the fact that the holding unit includes an articulated arm robot, in particular with 5 or 6 rotational axes.

Again a further preferred development of the apparatus according to the invention can be distinguished by the fact that the holding unit includes a suction gripper.

Again an added preferred development of the apparatus according to the invention can be distinguished by the fact that the print heads include in each case one closure which, in the closed state, protects the print head nozzles against radiation of the radiant heater.

Again an additional preferred development of the apparatus according to the invention can be distinguished by the fact that the print heads are received in each case in an aligning unit which makes an alignment of the print head possible linearly in the radial and tangential direction and axially about a print head axis which lies perpendicularly with respect to the plane of the circle.

Still another preferred development of the apparatus according to the invention can be distinguished by a projection unit which projects a marking onto the object in the receiving region.

Still a further preferred development of the apparatus according to the invention can be distinguished by a measuring unit which contactlessly measures at least one section of the surface of the object and makes the measured data which are obtained in the process available, in particular for correcting the spacing between the object and the print head or radiant heater.

Still an added preferred development of the apparatus according to the invention can be distinguished by a precuring unit which includes a radiant heater and precures the print.

A concomitant preferred development of the apparatus according to the invention can be distinguished by a delivery region, the holding unit moving the object from the active region of the curing unit to the delivery region, and the at least one control unit controlling the movement.

Other features which are considered as characteristic for the invention are set forth in the appended claims.

Although the invention is illustrated and described herein as embodied in an apparatus for printing a curved surface of an object, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
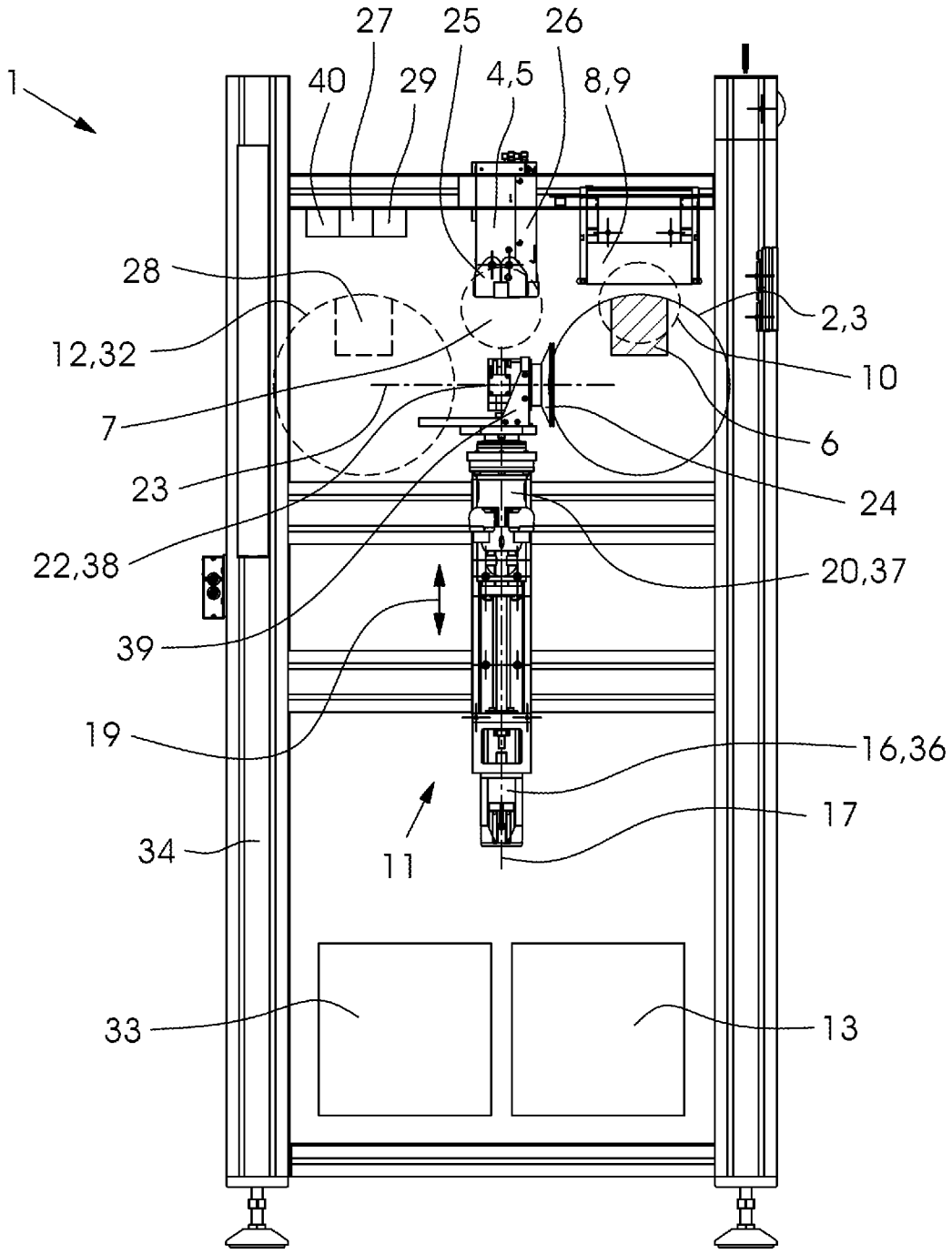
FIG. 1 is a diagrammatic, side-elevational view of a preferred embodiment of the apparatus according to the invention.
Figure 2:
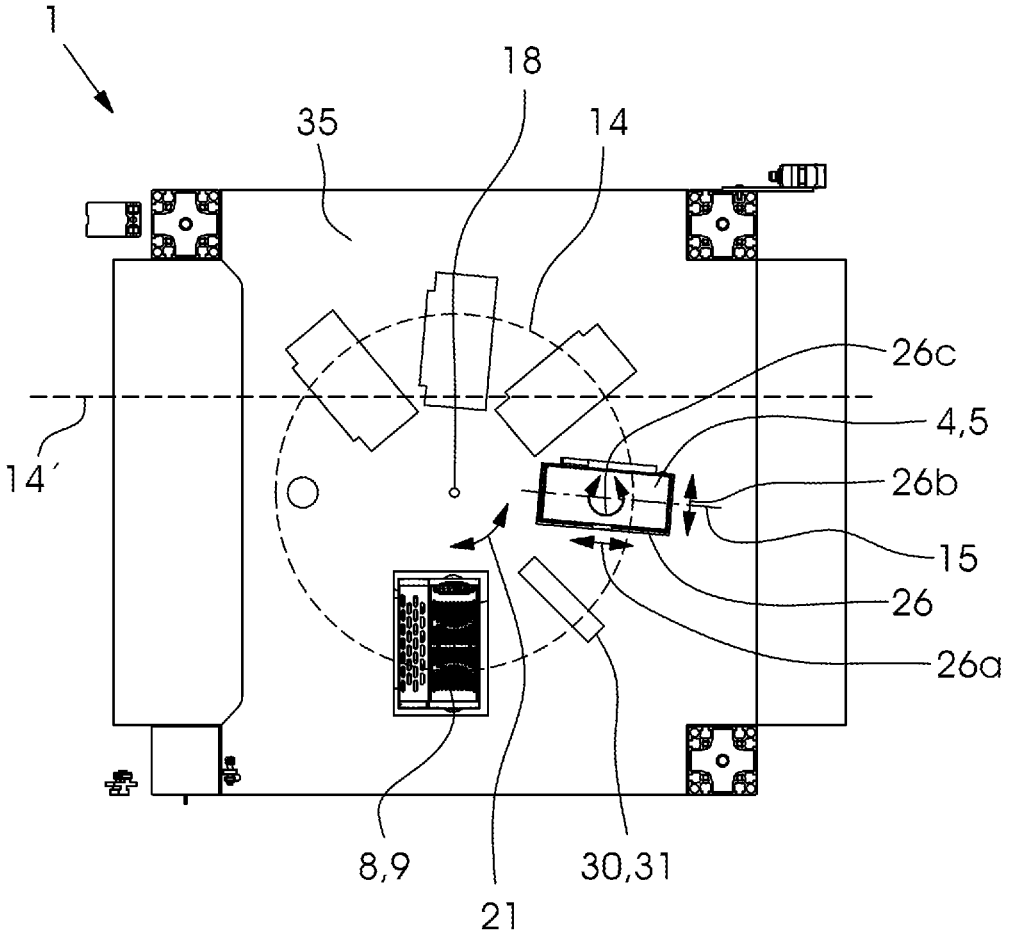
FIG. 2 is a plan view of the preferred embodiment of the apparatus according to the invention shown in FIG. 1.

Referring now to the figures of the drawings in detail and first, particularly, to FIG. 1 thereof, there is seen a side view of a preferred embodiment of an apparatus 1 according to the invention for individually printing a surface 3 of a three-dimensional moving object 2, in which the surface 3 is curved in any desired directions. The object can be a ball, for example. FIG. 2 shows a plan view of the same preferred embodiment of the apparatus 1 according to the invention. In the two drawings, elements which correspond to one another are provided with the same designations in each case.

The apparatus 1 includes a printing unit 4. The printing unit is disposed in a stationary manner in the upper region of the apparatus. The printing unit includes an inkjet print head 5. The print head is received in an aligning unit 26 of the printing unit. The aligning unit is disposed in an opening of a horizontally disposed plate 35 of a frame 34 of the apparatus 1. The plate has a plurality of openings, so that a configuration of a plurality of print heads is therefore possible. The openings and the plurality of print heads lie on a circle 14 about a center point 18. The openings can be provided in terms of their position, orientation and size in dependence on the size of the print heads and the size of the objects to be printed. Each print head prints one color in the form of ink droplets by using nozzles in nozzle rows 15. If a multiple-color print 6 is to be produced on the object 2 a plurality of print heads are provided, for example in accordance with known CMYK printing. However, even more print heads, for example up to seven, can be provided if special colors, white pigment or varnish are used. The print heads are connected through a non-illustrated ink supply to one or more ink supply vessels 33 in the lower region of the apparatus 1. The ink supply can also be provided outside the apparatus.

The print heads 5 can be adjusted in three directions by using their respective aligning unit 26 or print head receptacle, namely linearly in radial and tangential direction 26*a*, 26*b* with regard to the circle 14 and axially about a print head axis 26*c* which lies perpendicularly with respect to the plane of the circle. An alignment of this type is usually required only during setting up of the apparatus or in the case of maintenance. During printing, the print heads remain fixedly in their position. It is also possible to tilt the print heads in the direction of the center axis of the apparatus 1. This can be advantageous, in particular, in the case of elongate objects 2, in order to prevent them from colliding with the inactive print heads during printing.

The print heads 5 can be configured as two-color heads, with only one color being printed, however. In this case, the nozzles for the second color are used as reserve nozzles which are employed in the case of a nozzle failure for the first color.

A curing unit 8 including a radiant heater 9 is provided in a further opening on the same plate 35. The radiant heater is preferably a UV radiant heater if UV ink is used, but can also be an IR radiant heater. The radiant heater can be configured as an LED radiant heater. The radiant heater is also disposed on the circle 14. The print heads 5 are disposed on the circle so as to follow one another in one direction. The radiant heater is disposed so as to follow the print heads in this direction. The curing unit or the radiant heater has an active region 10. In addition to the curing unit, a precuring unit 30 (a so-called pinning module) with a radiant heater 31 can also be provided. A plurality of pinning modules can also be provided, in each case one behind each print head 4.

In order to protect the print heads 5 against radiation of the curing unit 8, respective closures 25 (so-called shutters) are provided on the print heads. Inactive heads are closed in the case of an active curing unit, as a result of which curing of ink on or even in the nozzles can be avoided. Each closure can have two pivotable shutters.

A modular holding unit 11 is disposed on the frame 34 below the plate 35, that is to say in the central region of the apparatus 1. The holding unit has a vertical axis 17 which runs substantially through the center point 18 of the circle 14. The holding unit serves to receive and transport and rotate the object 2, that is to say it holds the object during printing, with the object being moved. The object is received in a receiving region 12 and, for example, is transferred by hand or in an automated manner to a suction gripper 24. The latter can have a metallic suction plate with three or more suction openings (see the suction gripper 24 in FIG. 3).

In the receiving region, an optical marking 28 can optionally be projected onto the surface 3 of the object 2 by a projection unit 27, for example by using a laser or a so-called beamer or projector. By acting as a positioning aid, the marking facilitates the introduction of the object in a desired orientation for the operator. For example, the printable region on a ball 2 can be indicated by way of a marking frame, with the result that the operator can orient the ball with the region to be printed in the printable region.

As an alternative, a positioning cross can be projected onto the object by using laser light. The alignment of a ball can then preferably take place in such a way that a seam of the ball is oriented on the cross. Two crosses can also be projected onto the object at different locations (preferably at locations which lie opposite one another, for instance).

At least one section of the surface 3 of the object 2 can likewise be measured contactlessly in the receiving region, optionally by a measuring unit 29. The measuring unit can include a camera or a distance sensor. It serves to detect the shape of the object. In the case of a ball, measurements can be carried out, for example, as to whether the ball corresponds exactly to the ideal spherical shape or whether there are local or even global deviations. Deviations of this type can be calculated from the measured data, for example distance data, and can be stored. Later, the data can be used during the production of the print and the curing, by correcting the spacing of the units from the surface by way of a spacing correction of the object. The measured data can also be used to displace the image to be printed within the printable region in an automated manner. This can be necessary, for example, if the object has locations which cannot be printed, such as the seams of a sewn ball which are depressed and can therefore be detected satisfactorily.

It can optionally also be provided to pretreat the surface region to be printed of the object 2 with a primer, in order to improve the adhesion of the ink. To this end, a primer unit 40 can be provided, for example, in the receiving region 12. The primer unit 40 can have, for example, a transfer belt for the primer application. The belt can also be used to remove a (sample) print again which has been carried out and has not yet cured. The belt can also be used to clean the object before the primer application, in particular to clean it of dust.

The holding unit 11 preferably includes at least three modular movement units. A first movement unit 16 is disposed substantially on the vertical axis 17. The first movement unit includes a first (linear) drive 36 which makes a linear movement 19 of the object 2 in the vertical direction possible. This movement serves primarily to vertically align the object, in particular with regard to the respective spacing from the print heads 4 and from the radiant heater 9 during printing and irradiation.

The holding unit 11 includes a second movement unit 20. The latter is disposed on the first movement unit 16 and makes a rotational movement 21 of the object 2 about the vertical axis 17 possible, with the result that the object passes during its transport movement sequentially into the active region 7 of the print head 5 and the active region 10 of the radiant heater. To this end, the second movement unit includes a second (rotational) drive 37. The drive serves primarily for the transport movement of the object.

The holding unit 11 includes a third movement unit 22 with a third (rotational) drive 38. The unit is disposed on the second movement unit 20 and makes a rotational movement 21 of the object 2 about a radial axis 23 possible. In the case of a ball, the radial axis can preferably coincide with an axis of symmetry of the ball itself. The drive serves primarily for the rotational movement of the object during printing or curing. The third movement unit can also be disposed on an adjusting unit 39 and the latter in turn can be disposed on the second movement unit. The adjusting unit then preferably allows the radial adjustment of the third movement unit, for example for manual or automated presetting in the case of a defined ball size.

The holding unit 11 receives the object and conveys or cycles it from the receiving region 12 into the active region 7 of the print head 4 or sequentially into the active regions 7 of the plurality of print heads 4. After printing, the holding unit conveys or cycles the object into the active region of the curing unit 8. From there, it conveys or cycles the object into a delivery region 32. There, the ball is removed by hand or in an automated manner. The delivery region is preferably identical to the receiving region and is situated behind a lateral opening in the frame, which opening can be closed by way of a door. However, the delivery region and receiving region can also be different from one another.

If a pinning module 30 is provided, the holding unit 11 can convey the object from a print head to the pinning module and then to the next print head and from the last print head to the curing unit 8. A movement of this type can also include forward and reverse movements (in the circular direction).

The movement of the object 2 is controlled by a control unit 13 in the lower region of the apparatus 1. The control unit 13 controls at least the holding unit 11 or its drives 36, 37 and 38. The same control unit can also actuate the print heads 2 and the radiant heater 9, or at least their switch-on and switch-off times. The printing data for the print heads are fed directly or through the control unit 13 to the print heads from a non-illustrated unit of the so-called prepress stage.

When printing identical objects, such as balls 2, the holding unit 11 can advantageously always perform identical (preset and stored) movements, both for the transport of the ball and for the rotation during printing. The following is generally true (without being restricted to the embodiment which is shown): the holding unit 11 has a plurality of movement units, each movement unit generating a linear or rotational movement, only one movement unit being active for the linear or rotational movement of the object 2 from the receiving region 12 into the active region 7 of the print head 5 and from there into the active region 7 of a further print head or into the active region 10 of the radiant heater 9. In this way, positional errors of the object during printing and curing can be kept small in an advantageous way. If, nevertheless, substantial positional errors occur, they are reproducible and can therefore be taken into consideration, for example, during printing by way of correspondingly compensating printing data.

Balls are preferably printed with one or with two image strips by way of the apparatus 1 according to the invention. In this case, an individual image strip can span the entire ball circumference and can be at most as wide as the participating print head 4 can print in a single pass. It can be provided in the user interface of the apparatus to print any desired image in one of the strips and, for example, to complete a text or pattern.

However, it is also possible to print the entire ball, that is to say its surface 3 apart from the holding region. To this end, the holding unit 11 can have, for example, a further drive which allows the ball to be pivoted with regard to the print head 5 or its active region 7.

The modular holding unit 11 can also have up to six movement units or modules. These can be linear drives and rotational drives in any desired combination, depending on the shape of the object 2 which is to be imprinted. For example, the use of an articulated arm robot with up to six degrees of freedom is also preferred.

As an alternative to the circular configuration of the print heads 5 and the radiant heater 9, a linear configuration can be provided on a straight line, preferably a horizontally running straight line. In this case, the object 2 is moved by the holding unit 11 linearly from an active region 7 of a print head to the next active region 7 of a following print head or to the active region 10 of the radiant heater. A forward and reverse movement is also possible, for example if a single pinning module 30 is used.

Figure 3:
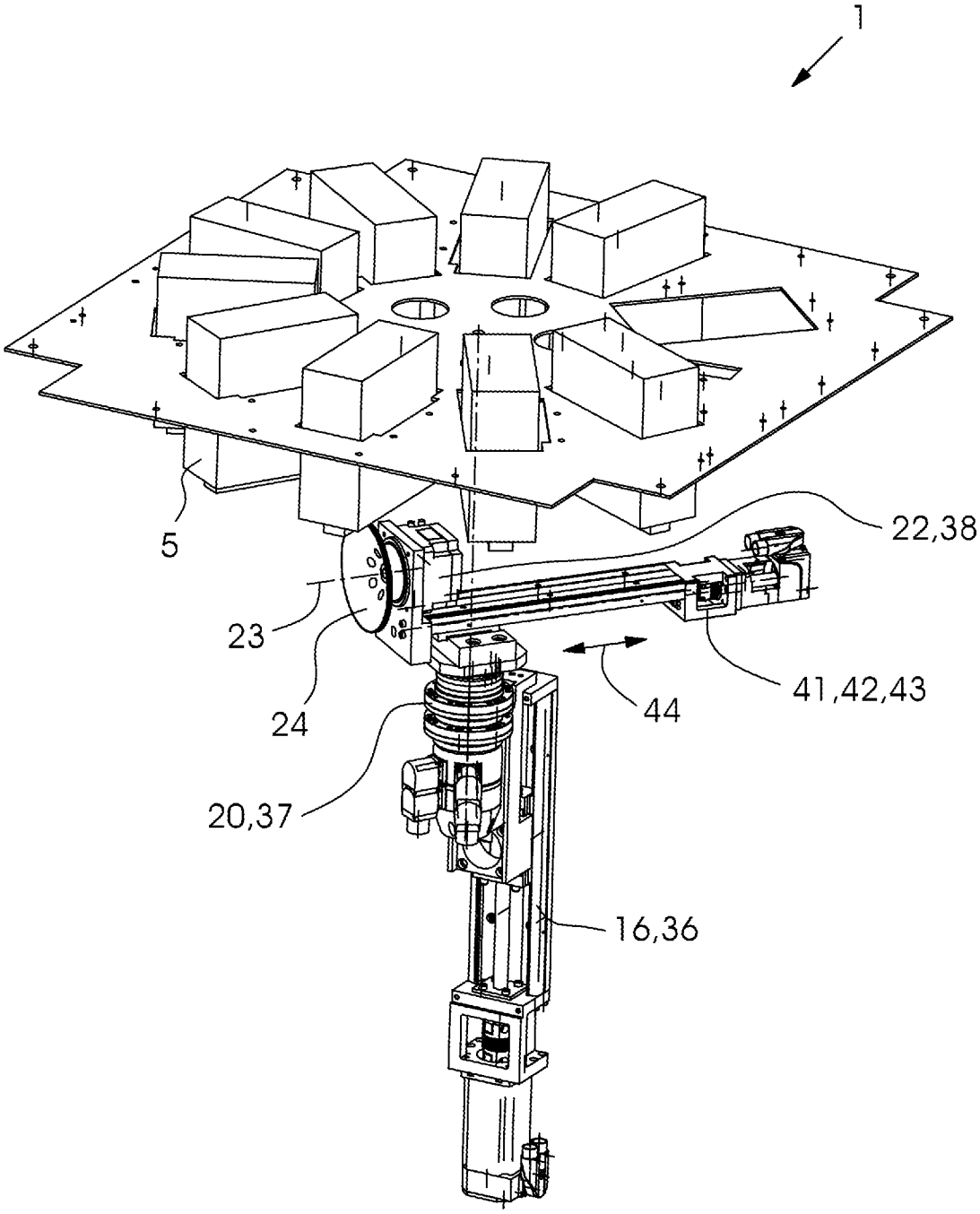
FIG. 3 is a perspective view of a preferred embodiment of a further apparatus according to the invention.

FIG. 3 shows a perspective view of a further embodiment of the invention. The apparatus 1 includes a first movement unit 16 with a linear drive 36, a second movement unit 20 with a rotational drive 37, and a third movement unit 22 with a rotational drive 38. In addition, the apparatus includes a fourth movement unit 41 with a linear drive 42 (servomotor). The fourth movement unit is disposed between the second and third movement units. The third movement unit is disposed on a carriage 43. The carriage allows a movement 44 in the radial direction (parallel to the radial axis 23). The rotational movement of the third movement unit and of the gripper 24 preferably takes place about a rotational axis which is parallel to the axis 23 or the thrust direction of the linear drive 42. The fourth movement unit 41 serves for adaptation/adjustment during printing of objects 2 of different sizes, for example balls of different diameter.

Printing by way of the apparatus 1 according to FIG. 3 takes place as follows:

The movement unit 16 serves for a compensation movement, if the object 2 deviates from its ideal shape (sphere, cylinder, etc.) or is clamped-in imprecisely. In this way, the spacing of the object from the print head 5 can be kept constant. The actual shape and clamping of the object are measured to this end and are transmitted to the control unit 13.

The movement unit 20 serves to cycle or cyclically move the object 2 from station to station (priming, printing, curing).

As has already been described above, the movement unit 41 serves for size adaptation. Balls and spherical objects 2 can be positioned in the radial direction in such a way that, for example, their equator comes to lie under the print head 5. The ball can thus preferably be printed with a printing track along the equator. Cylindrical objects are held with their cylinder axis parallel to the radial axis and are rotated about their cylinder axis. In the case of cylinders (for example, bottles, cans, etc.), the movement unit 41 serves for advancing in the radial direction, with the result that the objects can be provided with a plurality of adjacent circumferential printing tracks by one print head 5.

The movement unit 22 serves to rotate the object 2, in order to produce one or more printing tracks in the circumferential direction by way of the print head 5. This printing movement and the compensation movement (of the movement unit 16) proceed in a superimposed or simultaneous manner, if compensation is required.

The invention claimed is:

1. An apparatus for printing a curved surface of an object, the apparatus comprising:

a stationary printing unit for printing the object, said printing unit including a plurality of inkjet print heads having active regions and nozzle rows, said print heads being disposed substantially along a horizontally oriented circle and spaced apart from one another with said nozzle rows of said print heads being oriented substantially radially with respect to said circle, said print heads producing a print on the surface of the object in said active regions of said print heads;

a curing unit for curing the print, said curing unit including a radiant heating or curing device having an active region, and said radiant heating or curing device curing the print in said active region of said radiant heating or curing device;

a movable holding unit for receiving the object in a receiving region, for moving the object from said receiving region into said active region of said print head, for moving the object in said active region of said print head during the production of the print and for moving the object into said active region of said radiant heating or curing device;

said holding unit having a first movement unit being disposed substantially on a vertical axis and substantially perpendicularly below the center point of said circle and permitting a vertically linear movement of the object;

said holding unit having a second movement unit disposed on said first movement unit and disposed substantially on said vertical axis and permitting a rotational movement of the object about said vertical axis;

said holding unit having a third movement unit disposed on said second movement unit and permitting a rotational movement of the object about a radial axis; and at least one control unit for controlling the movements of said holding unit, the production of the print and the curing of the print.

2. The apparatus according to claim 1, wherein:

only one of said movement units is active for a linear or rotational movement of the object from said receiving region into said active region of said print head and from said active region of said print head into said active region of said further print head or into said active region of said radiant heating or curing device.

3. The apparatus according to claim 1, wherein said curing unit is disposed substantially on said horizontally oriented circle and spaced apart from said print heads.

4. The apparatus according to claim 1, wherein said holding unit includes an articulated arm robot.

5. The apparatus according to claim 4, wherein said articulated arm robot has five or six rotational axes.

6. The apparatus according to claim 1, wherein said holding unit includes a suction gripper.

7. The apparatus according to claim 1, wherein said print heads each have a respective closure protecting said print head nozzles against radiation of said radiant heating or curing device in a closed state of said closure.

8. The apparatus according to claim 1, which further comprises:

a plurality of aligning units;

said horizontally oriented circle being disposed in a plane, said print heads having print head axes lying perpendicularly with respect to the plane of said circle; and each of said print heads being received in a respective one of said aligning units permitting an alignment of a respective one of said print heads linearly in radial and tangential directions and axially about a respective one of said print head axes.

9. The apparatus according to claim 1, which further comprises a projection unit projecting a marking onto the object in said receiving region.

10. The apparatus according to claim 1, which further comprises a measuring unit contactlessly measuring at least one section of the surface of the object and making measured data obtained during the measuring available.

11. The apparatus according to claim 10, wherein the measured data is available for correcting a spacing between the object and said print head or said radiant heating or curing device.

12. The apparatus according to claim 1, which further comprises a precuring unit including a radiant heating or curing device, said precuring unit precuring the print.

13. The apparatus according to claim 1, which further comprises a delivery region, said holding unit moving the object, under control of said at least one control unit, from said active region of said curing unit to said delivery region.

14. An apparatus for printing a curved surface of an object, the apparatus comprising:

a stationary printing unit for printing the object, said printing unit including a plurality of inkjet print heads having active regions and nozzle rows, said print heads being disposed substantially along a horizontally oriented circle and spaced apart from one another with said nozzle rows of said print heads being oriented substantially radially with respect to said circle, said print heads producing a print on the surface of the object in said active regions of said print heads;

a curing unit for curing the print, said curing unit including a radiant heating or curing device having an active region, and said radiant heating or curing device curing the print in said active region of said radiant heating or curing device;

a movable holding unit for receiving the object in a receiving region, for moving the object from said receiving region into said active region of said print head, for moving the object in said active region of said print head during the production of the print and for moving the object into said active region of said radiant heating or curing device;

said holding unit having a first movement unit being disposed substantially on a vertical axis and substantially perpendicularly below the center point of said circle and permitting a vertically linear movement of the object;

said holding unit having a second movement unit disposed on said first movement unit and disposed substantially on said vertical axis and permitting a rotational movement of the object about said vertical axis;

said holding unit having a third movement unit and a fourth movement unit, said fourth movement unit being disposed on said second movement unit and permitting a linear movement of the object in a radial direction, and said third movement unit being disposed on said fourth movement unit and permitting a rotational movement of the object about a radial axis; and at least one control unit for controlling the movements of said holding unit, the production of the print and the curing of the print.

* * * * *